US008449404B2

(12) United States Patent
Thomas et al.

(10) Patent No.: US 8,449,404 B2
(45) **Date of Patent: *May 28, 2013**

(54) RELEASABLE AND INTERCHANGEABLE CONNECTIONS FOR GOLF CLUB HEADS AND SHAFTS

(75) Inventors: James S. Thomas, Fort Worth, TX (US); Gregory A. Trees, Columbus, OH (US); Vincent J. Contini, Powell, OH (US); Raymond J. Sander, Benbrook, TX (US); James Alan Prescott, Columbus, OH (US); Scott Allen Harris, Upper Arlington, OH (US); Matthew Paul Rubal, Columbus, OH (US)

(73) Assignee: Nike, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/303,755

(22) Filed: Nov. 23, 2011

(65) Prior Publication Data

US 2012/0071265 A1 Mar. 22, 2012

Related U.S. Application Data

(63) Continuation of application No. 12/366,484, filed on Feb. 5, 2009, now abandoned.

(51) Int. Cl.
*A63B 53/02* (2006.01)

(52) U.S. Cl.
USPC ..... 473/307; 473/309; 473/246; 473/288

(58) Field of Classification Search
USPC ..... 473/288, 307, 309, 310, 315, 244–248
See application file for complete search history.

(56) References Cited

U.S. PATENT DOCUMENTS 591,741 A 10/1897 Deem
1,019,657 A 3/1912 Kerr (Continued)

FOREIGN PATENT DOCUMENTS

EP 0300119 12/1992
GB 392493 5/1933

(Continued)

OTHER PUBLICATIONS

International Search Report in related International Application No. PCT/US2011/059727; mailed Jan. 30, 2012.

(Continued)

*Primary Examiner* — Stephen L. Blau
(74) *Attorney, Agent, or Firm* — Banner & Witcoff, Ltd.

(57) ABSTRACT

Golf club heads are releasably engaged with shafts so they may be readily interchanged and/or so that the shaft orientation with respect to the club head can be readily changed. Assemblies for connecting the club head and shaft may include a shaft adapter and a head adapter. The shaft adapter may have an exterior surface extending along a first axis and a bore having a cross-sectional shape along a second axis configured to attach to a shaft member. The second end of the shaft adapter has a cross-sectional shape of a regular polygon. The head adapter has a first end and a second end along a first axis and a bore having a shape of a regular polygon along a second axis that is shaped to receive the second end of the shaft adapter in a plurality of orientations.

16 Claims, 6 Drawing Sheets

U.S. PATENT DOCUMENTS 1,266,529 A 5/1918 Mattern
1,540,559 A 6/1925 Murphy
1,792,852 A 12/1926 Mattern
1,623,523 A 4/1927 Bourke
1,634,082 A 6/1927 Rigby
1,690,266 A 11/1928 Barrett
1,850,843 A 3/1932 Lagerblade
2,067,556 A * 1/1937 Wettlaufer ..... 473/308
2,219,670 A * 10/1940 Wettlaufer ..... 473/247
2,451,262 A 10/1948 Watkins
2,464,850 A 3/1949 Crawshaw
3,206,206 A 9/1965 Santosuosso
3,516,697 A 6/1970 Hahn
3,524,646 A 8/1970 Wheeler
3,596,938 A 8/1971 Tizzard
3,656,366 A 4/1972 Somero
3,848,737 A 11/1974 Kenon
3,891,212 A 6/1975 Hill
RE29,376 E 8/1977 Hiszpanski
4,253,666 A 3/1981 Murphy
4,340,227 A 7/1982 Dopkowski
4,664,382 A 5/1987 Palmer et al.
4,854,582 A 8/1989 Yamada
4,895,368 A * 1/1990 Geiger ..... 473/307
4,948,132 A 8/1990 Wharton
4,958,834 A 9/1990 Colbert
4,984,794 A 1/1991 Pernelle et al.
5,165,688 A 11/1992 Schmidt
5,232,224 A 8/1993 Zeider
5,275,399 A 1/1994 Schmidt
5,275,408 A 1/1994 Desbiolles et al.
5,429,355 A 7/1995 Schmidt
5,433,442 A 7/1995 Walker
5,577,726 A 11/1996 Fenton
5,588,921 A 12/1996 Parsick
5,626,528 A 5/1997 Toulon
5,792,002 A 8/1998 Bothwell
5,839,973 A 11/1998 Jackson
5,851,155 A 12/1998 Wood et al.
5,855,526 A 1/1999 Honma
5,906,549 A * 5/1999 Kubica ..... 473/314
5,951,411 A 9/1999 Wood et al.
6,095,929 A 8/2000 Clark
6,149,533 A 11/2000 Finn
6,203,443 B1 * 3/2001 Britton ..... 473/244
6,251,028 B1 6/2001 Jackson
6,270,425 B1 8/2001 Dyer
6,273,828 B1 * 8/2001 Wood et al. ..... 473/246
6,287,215 B1 9/2001 Fisher
6,319,146 B1 11/2001 Mills
6,332,945 B1 12/2001 Lenhof
6,368,230 B1 4/2002 Helmstetter et al.
6,447,404 B1 9/2002 Wilbur
6,475,100 B1 11/2002 Helmstetter et al.
6,508,288 B2 1/2003 Lenhof
6,547,673 B2 4/2003 Roark
6,652,388 B1 11/2003 Lenhof
6,669,573 B2 12/2003 Wood et al.
6,797,106 B2 9/2004 Lenhof
6,863,622 B1 3/2005 Hsu
6,890,269 B2 5/2005 Burrows
7,017,252 B2 3/2006 Lenhof
7,056,225 B1 6/2006 Pipkin
7,083,529 B2 8/2006 Cackett
7,115,046 B1 10/2006 Evans
7,144,330 B2 12/2006 Wade
7,300,359 B2 11/2007 Hocknell
7,316,622 B1 1/2008 Lucas
7,326,126 B2 2/2008 Holt
7,335,113 B2 2/2008 Hocknell
7,344,449 B2 3/2008 Hocknell et al.
7,424,953 B2 * 9/2008 McCarty et al. ..... 206/378
7,476,160 B2 1/2009 Hocknell et al.
7,621,821 B2 11/2009 Tsai et al.
7,699,717 B2 4/2010 Morris et al.
7,704,156 B2 * 4/2010 Stites et al. ..... 473/246
7,704,158 B2 4/2010 Burrows
7,722,474 B2 5/2010 Thomas et al.
7,722,475 B2 5/2010 Thomas et al.
7,789,766 B2 9/2010 Morris et al.
7,789,769 B2 9/2010 Sugimoto
7,887,431 B2 * 2/2011 Beach et al. ..... 473/307
7,931,542 B2 4/2011 Kusumoto
7,955,182 B2 6/2011 Thomas et al.
7,955,184 B2 6/2011 Stites et al.
7,955,185 B2 6/2011 Tavares et al.
7,963,856 B2 6/2011 Yamamoto
7,980,959 B2 7/2011 Morris et al.
8,002,644 B2 8/2011 Hocknell et al.
8,182,357 B2 * 5/2012 Moore ..... 473/246
2002/0037773 A1 3/2002 Wood et al.
2003/0050130 A1 3/2003 Wade
2004/0018886 A1 1/2004 Burrows
2004/0018887 A1 1/2004 Burrows
2004/0023728 A1 2/2004 Drossos
2005/0049072 A1 3/2005 Burrows
2006/0105855 A1 5/2006 Cackett et al.
2006/0183564 A1 8/2006 Park
2006/0281575 A1 12/2006 Hocknell et al.
2006/0293116 A1 12/2006 Hocknell et al.
2007/0004528 A1 1/2007 Hocknell et al.
2007/0078026 A1 4/2007 Holt et al.
2007/0117645 A1 5/2007 Nakashima
2007/0173344 A1 7/2007 Burch
2007/0265106 A1 11/2007 Burrows
2008/0051211 A1 2/2008 Hocknell
2008/0058114 A1 3/2008 Hocknell
2008/0070717 A1 3/2008 Hocknell et al.
2008/0268977 A1 10/2008 Cole et al.
2008/0280693 A1 * 11/2008 Chai ..... 473/288
2009/0011848 A1 1/2009 Thomas et al.
2009/0011849 A1 1/2009 Thomas et al.
2009/0011850 A1 1/2009 Stites et al.
2009/0062029 A1 3/2009 Stites et al.
2009/0075748 A1 3/2009 Evans et al.
2009/0156323 A1 6/2009 Yamamoto
2009/0181791 A1 7/2009 Sanchez et al.
2009/0197694 A1 8/2009 Soracco et al.
2009/0239676 A1 9/2009 Bennett et al.
2009/0286618 A1 11/2009 Beach et al.
2009/0286619 A1 11/2009 Beach et al.
2010/0035701 A1 2/2010 Kusumoto
2010/0041491 A1 2/2010 Thomas et al.
2010/0197422 A1 8/2010 Thomas et al.
2010/0197423 A1 8/2010 Thomas et al.
2011/0152000 A1 6/2011 Sargent et al.
2012/0122601 A1 5/2012 Beach et al.

FOREIGN PATENT DOCUMENTS

GB 443439 2/1936
GB 751323 6/1956
GB 2331464 5/1999
JP 2000-005349 A 1/2000
JP 2000024143 1/2000
JP 2000093569 4/2000
JP 2002-119630 A 4/2002
JP 2002282400 10/2002
JP 2004534599 11/2004
JP 2005270402 10/2005
JP 2006042950 2/2006
JP 2006042951 4/2006
NZ 575598 3/2009
WO 9000424 1/1990
WO 9609856 4/1996
WO 2004009186 1/2004
WO 2007022671 3/2007
WO WO2008016784 A2 2/2008
WO 2009009262 1/2009
WO 2009035345 3/2009

OTHER PUBLICATIONS

Chinese Office Action in related Chinese Application No. 200980132894.7; issued Jan. 4, 2012.

International Search Report in related International PCT Application No. PCT/US2010/042434; mailed Dec. 20, 2010.

International Search Report in related International PCT Application No. PCT/US2010/022699; mailed Apr. 26, 2010.
Canadian Office Action in related Canadian Application No. 2692345; dated Aug. 5, 2011.
Japanese Office Action in related Japanese Application No. 2010-514982; dated Feb. 22, 2012.
Chinese Office Action in related Chinese Application No. 200880101899.9; issued Aug. 3, 2011.
Australian Office Action in related Australian Application No. 2008275470; dated Oct. 14, 2010.
International Search Report in related International Application No. PCT/US08/67348; dated Nov. 7, 2008.
Canadian Office Action in related Canadian Application No. 2692356; dated Aug. 12, 2011.
Korean Office Action in related Korean Application No. 1020107001608; delivered Oct. 11, 2011.
Chinese Office Action in related to Chinese Application No. 200880102102.7; dated Apr. 8, 2011.
Australian Office Action in related Australian Application No. 2008275411; dated Feb. 9, 2011.
International Search Report in related International PCT Application No. PCT/US08/68083; dated Nov. 7, 2008.
International Search Report in related International PCT Application No. PCT/US08/73703; dated Jan. 21, 2009.
International Preliminary Report in related PCT Application No. PCT/US08/73703; dated Mar. 11, 2010.
Canadian Office Action in related Canadian Application No. 2696921; dated Aug. 9, 2011.
Korean Office Action in related Korean Application No. 10-2010-7005698; dated Dec. 5, 2011.
Australian Office Action in related Australian Application No. 2008296600; dated Dec. 10, 2010.
Australian Office Action in related Australian Application No. 2008296600; dated Jan. 20, 2012.
Canadian Office Action in related Canadian Application No. 2692267; dated Aug. 11, 2011.
Chinese Office Action in related Chinese Application No. 200880100721.2; mailed Oct. 28, 2010.
Australian Office Action in related Australian Application No. 2008275414; dated Oct. 14, 2010.
International Search Report in related International PCT Application No. PCT/US08/68116; dated Nov. 11, 2008.
International Preliminary Report in related International PCT Application No. PCT/US08/68116; dated Jan. 21, 2010.
International Search Report in related International PCT Application No. PCT/US10/25880; dated Dec. 6, 2010.
Australian Office Action in related Australian Application No. 2009274322; dated Jan. 18, 2012.
International Search Report in related International PCT Application No. PCT/US09/50344; dated Dec. 22, 2009.
International Preliminary Report in related International PCT Application No. PCT/US09/50344; dated Feb. 3, 2011.
International Search Report in related International Application No. PCT/US10/38585; dated Aug. 30, 2010.
PUKU, Technology Update Article, Mar. 23, 2009, pp. 1-5.
European Search Report in related European Patent Application No. 03748963.0; dated Apr. 7, 2008.
Japanese Office Action in related Japanese Application No. 2010-515058; dispatched Mar. 8, 2012.
Japanese Office Action in related Japanese Application No. 2010-515046; dispatched Mar. 8, 2012.
International Search Report in related International Application No. PCT/NZ2008/000233; mailed Jan. 14, 2009.
U.S. Office Action from U.S. Appl. No. 12/944,458; mailed Nov. 28, 2012.
Office Action from Japanese Appln. No. 2011-549203, dated Mar. 21, 2013.

* cited by examiner

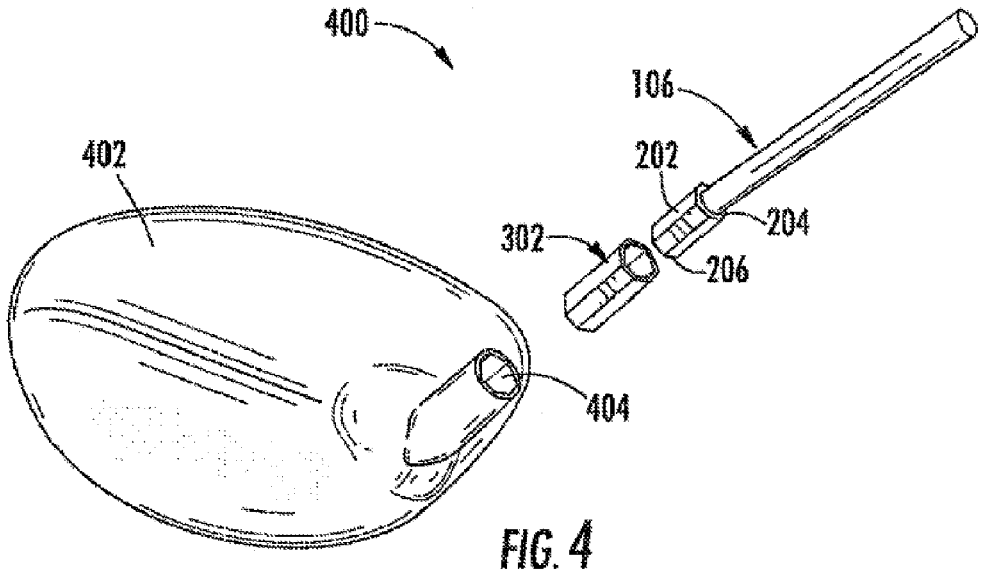
FIG. 4
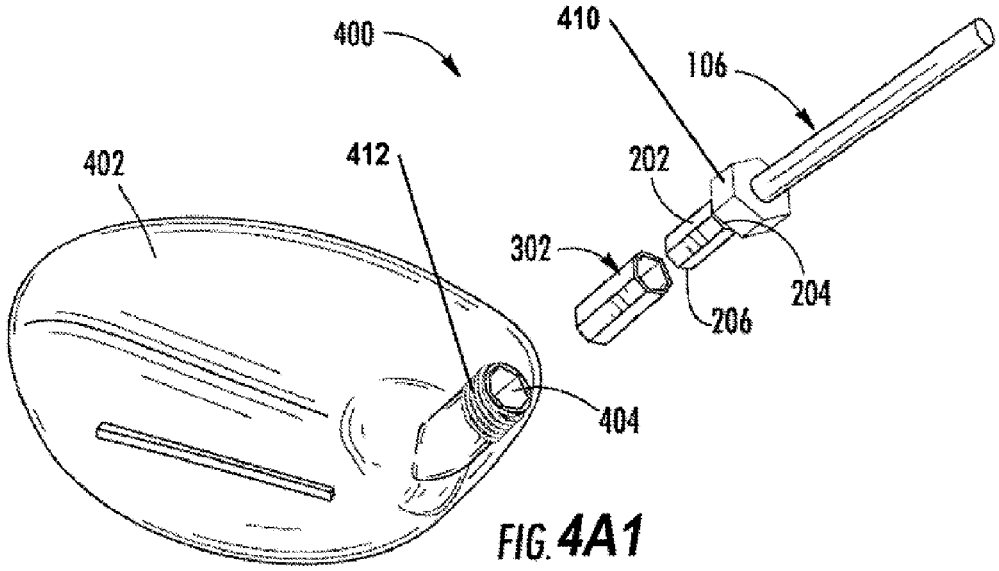
FIG. 4A1

600

| | SHAFT POSITION 602 | DELTA FACE ANGLE 604 | DELTA LIE ANGLE 606 | DELTA LOFT 608 |
|---|---|---|---|---|
| 610 | 1 | 0.0 | 3.0 | 0.0 |
| 612 | 2 | -0.7 | 2.4 | 1.2 |
| | 3 | -1.0 | 1.0 | 1.7 |
| | 4 | -0.7 | -0.4 | 1.2 |
| | 5 | 0.0 | -1.0 | 0.0 |
| | 6 | 0.7 | -0.4 | -1.2 |
| | 7 | 1.0 | 0.6 | -1.7 |
| | 8 | 0.7 | 2.4 | -1.2 |
| | 1 | 0.0 | 3.0 | 0.0 |

Fig. 6

RELEASABLE AND INTERCHANGEABLE CONNECTIONS FOR GOLF CLUB HEADS AND SHAFTS

RELATED APPLICATIONS

This application is a continuation application of U.S. patent application Ser. No. 12/366,484 filed Feb. 5, 2009, which is hereby incorporated by reference in its entirety.

FIELD OF THE INVENTION

This invention relates generally to golf clubs and golf club heads. More particularly, aspects of this invention relate to golf clubs having releasable connections between the golf club head and the shaft and head/shaft position adjusting features to allow easy interchange of shafts and heads and to allow easy modification of the head/shaft positioning properties. Additionally, features of this invention are similar in structure and function to features of the invention as described, for example, in U.S. patent application Ser. No. 11/774,513 filed Jul. 6, 2007 in the names of Gary G. Tavares, et al., which application is entirely incorporated herein by reference.

BACKGROUND

Golf is enjoyed by a wide variety of players—players of different genders and dramatically different ages and/or skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with the increased availability of golf programming on television (e.g., golf tournaments, golf news, golf history, and/or other golf programming) and the rise of well known golf superstars, at least in part, have increased golf's popularity in recent years, both in the United States and across the world.

Golfers at all skill levels seek to improve their performance, lower their golf scores, and reach that next performance "level." Manufacturers of all types of golf equipment have responded to these demands, and in recent years, the industry has witnessed dramatic changes and improvements in golf equipment. For example, a wide range of different golf ball models now are available, with balls designed to complement specific swing speeds and/or other player characteristics or preferences, e.g., with some balls designed to fly farther and/or straighter; some designed to provide higher or flatter trajectories; some designed to provide more spin, control, and/or feel (particularly around the greens); some designed for faster or slower swing speeds; etc. A host of swing and/or teaching aids also are available on the market that promise to help lower one's golf scores.

Being the sole instrument that sets a golf ball in motion during play, golf clubs also have been the subject of much technological research and advancement in recent years. For example, the market has seen dramatic changes and improvements in putter designs, golf club head designs, shafts, and grips in recent years. Additionally, other technological advancements have been made in an effort to better match the various elements and/or characteristics of the golf club and characteristics of a golf ball to a particular user's swing features or characteristics (e.g., club fitting technology, ball launch angle measurement technology, ball spin rates, etc.).

Given the recent advances, there is a vast array of golf club component parts available to the golfer. For example, club heads are produced by a wide variety of manufacturers in a variety of different models. Moreover, the individual club head models may include multiple variations, such as variations in the loft angle, lie angle, offset features, weighting characteristics (e.g., draw biased club heads, fade biased club heads, neutrally weighted club heads, etc.). Additionally, the club heads may be combined with a variety of different shafts, e.g., from different manufacturers; having different stiffnesses, flex points, kick points, or other flexion characteristics, etc.; made from different materials; etc. Between the available variations in shafts and club heads, there are literally hundreds of different club head/shaft combinations available to the golfer.

Club fitters and golf professionals can assist in fitting golfers with a golf club head/shaft combination that suits their swing characteristics and needs. Conventionally, however, golf club heads are permanently mounted to shafts using cements or adhesives. Therefore, to enable a golfer to test a variety of head/shaft combinations, the club fitter or professional must carry a wide selection of permanently mounted golf club head/shaft combinations (which takes up a considerable amount of storage space and inventory costs) or the club fitter or professional must build new clubs for the customer as the fitting process continues (which takes a substantial amount of time and inventory costs). The disadvantages associated with these conventional options serve to limit the choices available to the golfer during a fitting session and/or significantly increase the expense and length of a session.

SUMMARY

The following presents a general summary of aspects of the invention in order to provide a basic understanding of the invention and various features of it. This summary is not intended to limit the scope of the invention in any way, but it simply provides a general overview and context for the more detailed description that follows.

Aspects of this invention relate to systems and methods for connecting golf club heads to shafts in a releasable manner so that the club heads and shafts can be readily interchanged and/or so that the angle and/or position of the shaft with respect to the club head body (and its ball striking face) can be readily changed. Golf club head/shaft connection assemblies in accordance with examples of this invention may include a shaft adapter with an exterior surface having a cross-sectional shape of a regular polygon and an interior bore provided along an axis offset from the axis of the exterior surface. The shaft adapter is configured to attach to a shaft member. The shaft adapter according to some examples of the invention is also configured to securely and releasably engage a head adapter.

The head adapter includes a bore having the shape of a regular polygon along an offset axis with respect to the exterior surface of the head adapter. The head adapter is shaped to receive the shaft adapter in a plurality of different orientations. In further embodiments, the invention comprises a golf club with a club head having a hosel area that may receive the head adapter as described above in a plurality of different orientations. Yet in other embodiments, the head adapter may be formed integral with a hosel area of a club head (as a unitary, one piece construction). In still yet further embodiments, the golf club further comprises a shaft member, wherein the shaft adapter may be integrally with the shaft member (as a unitary, one piece construction).

Further aspects of this invention relate to methods of assembling a golf club. According to one exemplary method, a shaft member is attached to the shaft adapter having a first end and a second end along a first axis, wherein the shaft member is inserted within a bore provided along a second axis. The method may further comprise inserting the second end of the shaft adapter within a bore of a head adapter, wherein the head adapter comprises a first end and a second end along a first axis and wherein the bore has the cross-sectional shape of a regular polygon along a second axis that is shaped to receive the second end of the shaft adapter in a plurality of different orientations.

Other methods according to certain embodiments of the invention may further comprise inserting the head adapter into a hosel area of a club head. In select embodiments, the head adapter may be inserted into the hosel area in one of a plurality of different orientations. Further methods may include removing the shaft adapter from the head adapter and reinserting the second end of the shaft adapter into the bore of the head adapter in a different orientation and/or removing the head adapter from the hosel area of the club head and reinserting the head adapter into the hosel area of the club head in a different orientation.

Further aspects of the invention relate to marketing, selling, manufacturing, or utilizing one or more components of the golf club as a kit. The kit, including at least the shaft adapter and the head adapter as described above, may be associated with instructions for constructing a golf club by choosing between one or more heads, shafts, shaft adapters, grips, head adapters, etc. Furthermore, the shaft and/or the shaft adapter may be angled with respect to the axial direction of the club head hosel or club head engaging member so as to allow adjustment of the angle or position of the shaft with respect to the club head (e.g., with respect to its ball striking face). Instructions for making the adjustments and/or information detailing the characteristics of the club in relation to the adjustments may also be provided as part of one or more kits in accordance with embodiments of the invention.

BRIEF DESCRIPTION OF THE DRAWINGS

A more complete understanding of the present invention and certain advantages thereof may be acquired by referring to the following detailed description in consideration with the accompanying drawings, in which:

FIG. 4 is an exploded view of an example golf club having a shaft adapter and a head adapter according to one embodiment of the invention;

FIG. 4A1 is an exploded view of another example golf club having a shaft adapter and a head adapter with a threaded nut according to one embodiment of the invention;

FIG. 6 shows a table comprising exemplary information relating to the adjustment of the shaft adapter in relation to the club head according to one embodiment of the invention.

The reader is advised that the attached drawings are not necessarily drawn to scale.

DETAILED DESCRIPTION

In the following description of various example structures in accordance with the invention, reference is made to the accompanying drawings, which form a part hereof, and in which are shown by way of illustration various example connection assemblies, golf club heads, and golf club structures in accordance with the invention. Additionally, it is to be understood that other specific arrangements of parts and structures may be utilized, and structural and functional modifications may be made without departing from the scope of the present invention. Also, while the terms "top," "bottom," "front," "back," "rear," "side," "underside," "overhead," and the like may be used in this specification to describe various example features and elements of the invention, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of this invention.

In general, as described above, aspects of this invention relate to systems and methods for connecting golf club heads to shafts in a releasable manner so that the club heads and shafts can be readily interchanged and/or repositioned with respect to one another. Specific examples of the invention are described in more detail below. The reader should understand that these specific examples are set forth merely to illustrate examples of the invention, and they should not be construed as limiting the invention.

A. Examples of Specific Embodiments

1. Exemplary Club Structure

Figure 1:
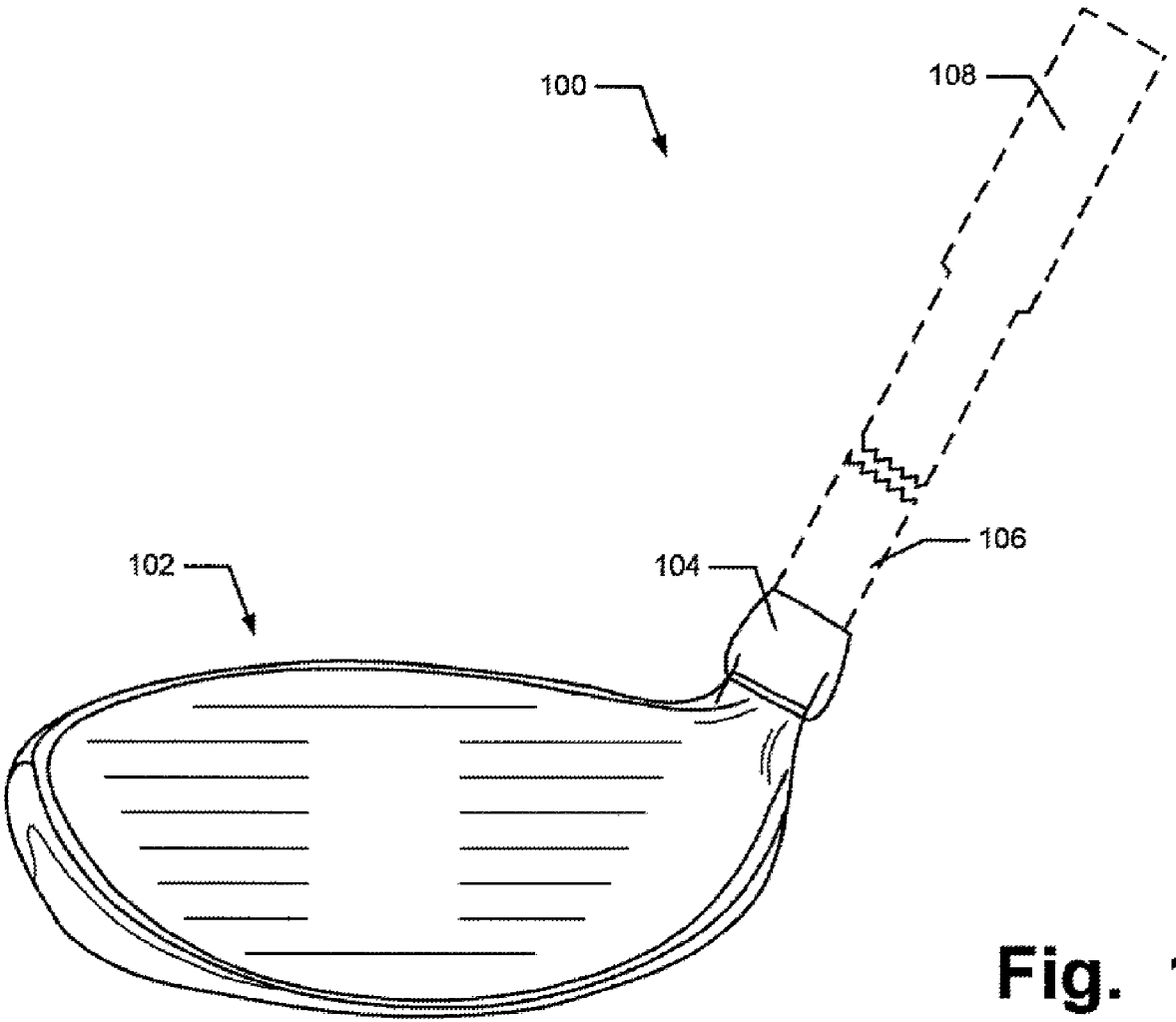
FIG. 1 generally illustrates a frontal view of an exemplary golf club according to embodiments of the invention.

FIG. 1 generally illustrates an exemplary golf club 100 in accordance with at least some embodiments of the invention. Exemplary club 100 includes a club head 102, a releasable club head/shaft connection system 104 that connects the club head 102 to a shaft member 106 (which will be described in more detail below), and a grip member 108 engaged with the shaft member 106. While a driver/wood-type golf club head 102 is illustrated in FIG. 1, aspects of this invention may be applied to any type of club head, including, for example: fairway wood club heads; iron type golf club heads (of any desired loft, e.g., from a 0-iron or 1-iron to a wedge); wood or iron type hybrid golf club heads; putter heads; and the like. The club heads may be made from suitable materials, in suitable constructions, in suitable manners, as are known and used in the art, optionally modified (if necessary, e.g., in size, shape, etc.) to accommodate the releasable club head/shaft connection parts.

The various parts of the club head/shaft connection system 104 may be made from any desired or suitable materials without departing from this invention. For example, one or more of the various parts may be made from a metal material, including lightweight metals conventionally used in golf club head constructions, such as aluminum, titanium, magnesium, nickel, alloys of these materials, steel, stainless steel, and the like, optionally anodized finished materials. Alternatively, if desired, one or more of the various parts of the connection system 104 may be made from rigid polymeric materials, such as polymeric materials conventionally known and used in the golf club industry. The various parts may be made from the same or different materials without departing from this invention. In one specific example, each of the various parts will be made from a 7075 aluminum alloy material having a hard anodized finish. The parts may be made in suitable manners as are known and used in the metal working and/or polymer production arts.

Any desired materials also may be used for the shaft member 106, including suitable materials that are known and used in the art, such as steel, graphite, polymers, composite materials, combinations of these materials, etc. Optionally, if necessary or desired, the shaft may be modified (e.g., in size, shape, etc.) to accommodate the releasable club head/shaft connection parts 104. The grip member 108 may be engaged with the shaft 106 in any desired manner, including in any suitable manners that are known and used in the art (e.g., via cements or adhesives, via mechanical connections, etc.). Any desired materials may be used for the grip member 108, including suitable materials that are known and used in the art, such as rubber, polymeric materials, cork, rubber or polymeric materials with cord or other fabric elements embedded therein, cloth or fabric, tape, etc. Optionally, if desired, the grip member 108 (or any suitable handle member) may be releasably connected to the shaft 106 using a releasable connection like releasable connection 104 (examples of which will be described in more detail below).

The releasable connection 104 between golf club heads and shafts in accordance with some examples of this invention now will be described in more detail in conjunction with FIGS. 2 through 6.

2. Exemplary Shaft Adapter

Figure 2:
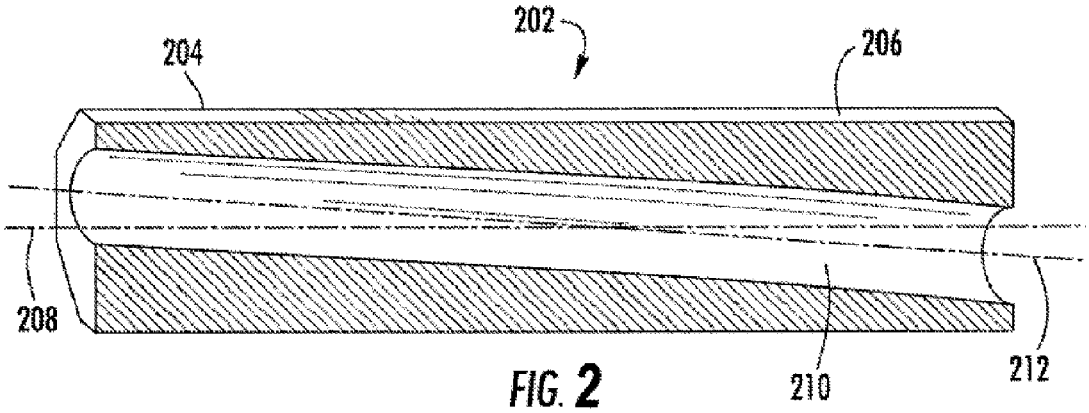
FIG. 2 is a cross-sectional perspective view of an example shaft adapter according to certain embodiments of the invention.

FIG. 2 is a cross-sectional perspective view of an example shaft adapter 202 according to certain embodiments of the invention. The shaft adapter 202 may be made from one or more suitable materials as described above and may comprise materials that are different than the materials comprising the remaining sections of the golf club. For example, in one embodiment, the shaft adapter 202 may comprise or include rubber or another compressible material that may increase the surface tension and/or reduce movement between the shaft adapter 202, the shaft member 106, and/or the head adapter (302, described below). In yet other embodiments, rubber and/or other materials may be used to increase shock absorbency and/or to reduce noise during a ball strike. In yet other embodiments, the shaft adapter 202 may be constructed from a lightweight metal, metal alloy, or polymeric material (e.g., a rigid polymeric material).

As shown in FIG. 2, shaft adapter 202 has a first end 204 and a second end 206, wherein the first end 204 is along the same axis 208 as the second end 206. The shaft adapter 202 further comprises a bore 210 along a second axis 212 configured to attach to a shaft member 106 on the second axis 212. Thus, the cylindrical exterior of the shaft adapter 202 extends in one axial direction (along axis 208) from the first end 204 to the second end 206, while the cylindrical bore 210 that receives the shaft member 106 extends in a different axial direction (axis 212). Those skilled in the art will readily appreciate upon review of this disclosure that there are various combinations of structural elements and/or processes that may be used to implement the two axes 208, 212 of shaft adapter 202. The angular difference between the first axis 208 and the second axis 212, maybe any angle without departing from this invention, e.g., at least 0.25 degrees, at least 0.5 degrees, at least 1 degree, at least 2 degrees, at least 2.5 degrees, at least 4 degrees, or even at least 8 degrees.

In the example embodiment shown in FIG. 2, the bore 210 has a circular cross-sectional shape, e.g., to receive a conventionally shaped round shaft. If desired, however, the cross-sectional shape of the bore 210 may be, for example, a polygon having any number of sides, such as: 12 or fewer sides, 10 or fewer sides, eight or fewer sides, six or fewer sides, or even four or fewer sides. The cross-sectional shape of the bore 210 may be configured to have a size and shape adapted to inhibit rotation of the shaft member 106 with respect to the shaft adapter 202. This may be due to the shaft adapter's bore 210 having the same general polygon shape as the shaft member 106. Yet in other embodiments, only a portion of the bore 210 engages or mates with the shaft member 106, however, the mating prevents rotation of the shaft adapter 202 within the shaft member 106. In some more specific example structures according to the invention, a portion of the shaft member 106 will have a square or rectangular cross section and the bore 210 of the shaft adapter 202 will include a multi-sided polygon shaped opening (e.g., with 4, 6, 8, 12, or 16 sides) that receives shaft member 106. Alternatively, if desired, the shaft adapter 202 may be permanently engaged with the shaft member 106, e.g., using cements or adhesives, using fusing techniques (such as welding, brazing, or soldering), etc., particularly in example structures in which the bore 210 and the shaft member 106 have round cross-sections.

In some example embodiments, at least one of the bore 210 and/or the shaft member 106 may have a different quantity of "sides" or protrusions than the other, however, the cross-sectional shapes of the various structures still allow the secure insertion of the shaft member 106 within the shaft adapter's bore 210 without allowing the shaft member 106 to rotate freely within the bore 210. In one such embodiment, the number of "sides" of the either the bore 210 or the shaft member 106 is a multiple of the number of sides on the other. Other such rotation-inhibiting structures and arrangements also are possible without departing from this invention. For example, either one or both of the shaft adapter 202 and/or the shaft member 106 may include mechanical structures, such as spring loaded pins or other extending structures that extend into openings, slots, or ridges (e.g., akin to attachment of hydraulic hoses to their hydraulic oil supply connection elements). Detent mechanisms and other physical (and optionally static) securing structures that fit into openings, slots, or ridges also may be used as a releasable rotation-inhibiting connection without departing from this invention.

Looking briefly to FIG. 4 (which will be discussed in more detail below), the shaft adapter 202 is configured to securely attach to the shaft member 106. The exemplary shaft adapter 202 may be hollow and may be sized to receive a free end portion of a golf club shaft, such as shaft member 106. Yet in other embodiments, the exemplary shaft adapter 202 may be sized to be received within a hollow portion at the free end of a golf club shaft, such as shaft member 106. Those skilled in the art will readily appreciate that the shaft adapter 202 is not required to be hollow and may securely attach to a club shaft by any suitable methods and mechanisms, including for example, e.g., via cements or adhesives; via welding, brazing, soldering, or other fusing techniques; via mechanical connectors; via a friction fit; etc. In some embodiments, the connection of the shaft adapter 202 to a shaft member 106, may be releasable, so as to allow shafts to be easily and quickly switched. Yet, in other embodiments, the shaft adapter 202 may be integral to or otherwise permanently affixed to the shaft member 106. As further illustrated in FIGS. 2 and 4, the exterior surface of the shaft adapter 202 may be a cross-sectional shape of a regular polygon. The cross-sectional shape may be, for example, a polygon having 16 or fewer sides, 12 or fewer sides, 10 or fewer sides, eight or fewer sides, six or fewer sides, or even four or fewer sides). The cross-sectional shape of the exterior surface of the shaft adapter is configured to have a size and shape adapted to fit into the head adapter (as described below) and inhibit rotation of the shaft adapter 202 with respect to the head adapter 302.

In some embodiments, the exterior sides of the shaft adapter 202, the shaft member 106 and/or the head adapter (discussed below) may be tapered in the axial direction such that the diameter of the component either increases or decreases along the axial direction. This feature can assist in making the shaft adapter 202 easily fit into and slide out of the head adapter and/or avoid the need to maintain extremely strict tolerances in the manufacturing procedures.

3. Exemplary Head Adapter

Figure 2A:
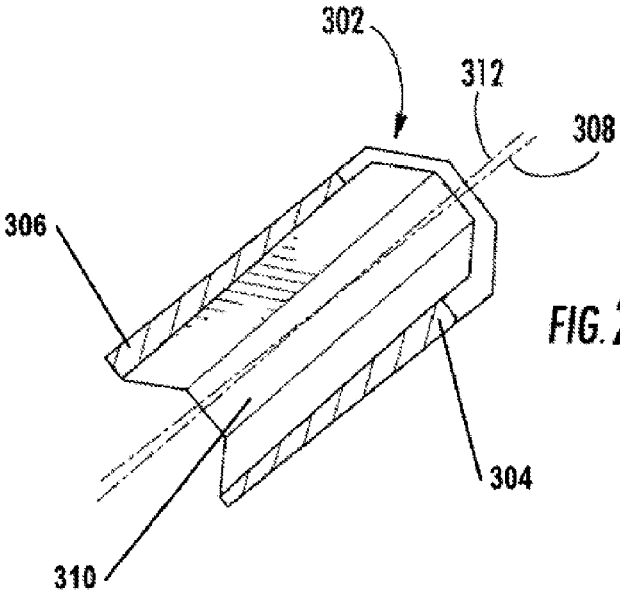
FIG. 2A is a cross-sectional perspective view of an example head adapter according to certain embodiments of the invention.

Exemplary connection 104 may further include a head adapter 302. Looking to FIG. 2A and FIG. 3, the head adapter 302 has a first end 304 and a second end 306. As seen, the first end 304 is along the same axis 308 as the second end 306. The head adapter 302 further comprises a bore 310 along a second axis 312 configured to receive the shaft adapter 202 on the second axis 312 (in turn the shaft adapter 202 receives shaft member 106). Thus, the exterior of the head adapter 302 may extend in one axial direction (axis 308) from the first end 304 to the second end 306, while the bore 310 that receives the shaft adapter 202 extends in a different axial direction (axis 312). Those skilled in the art will readily appreciate upon review of this disclosure there are various combinations of structural elements and/or processes that may be used to implement the two axes of head adapter 302 without departing from the scope of the invention. The angular difference between the first axis 308 and the second axis 312, may be any angle without departing from this invention, e.g., at least 0.25 degrees, at least 0.5 degrees, at least 1 degree, at least 2 degrees, at least 2.5 degrees, at least 4 degrees, or even at least 8 degrees.

The bore 310 of the head adapter 302 has the cross-sectional shape of a regular polygon. The cross-sectional shape may be, for example, a polygon having 12 or fewer sides, 10 or fewer sides, eight or fewer sides, six or fewer sides, or even four or fewer sides. The cross-sectional shape of the bore 310 is configured to have a size and shape adapted to inhibit rotation of the shaft adapter 202 with respect to the head adapter 302. This may be due to the head adapter's bore 310 having the same general polygon shape as the exterior surface of the shaft adapter 202, as described above. Yet in other embodiments, only a portion of the bore 310 engages or mates with the shaft adapter 202, however, the mating prevents rotation of the shaft adapter 202 within the head adapter 302. In some more specific example structures according to the invention, the shaft adapter 202 will have a square or rectangular cross section and the bore 310 of the head adapter 302 will include a multi-sided polygon shaped opening (e.g., with 4, 8, 12, or 16 sides) that receives the shaft adapter 202.

Thus, at least one of the bore 310 and/or the exterior surface of the shaft adapter 202 may have a different quantity of "sides" or protrusions than the other, however, the cross-sectional shapes of the various structures still allow the secure insertion of the shaft adapter 202 within the head adapter's bore 310 without allowing the shaft adapter 202 to rotate freely within the bore 310. In one such embodiment, the number of "sides" of the either the bore 310 or the shaft adapter 202 is a multiple of the number of sides on the other. Other such rotation-inhibiting structures and arrangements also are possible without departing from this invention. For example, either or both of the head adapter 302 or the shaft adapter 202 may include mechanical structures, such as spring loaded pins or other extending structures that extend into openings, slots, or ridges (e.g., akin to attachment of hydraulic hoses to their hydraulic oil supply connection elements). Detent mechanisms and other physical (and optionally static) securing structures that fit into openings, slots, or ridges also may be used as a releasable rotation-inhibiting connection without departing from this invention.

Figure 3:
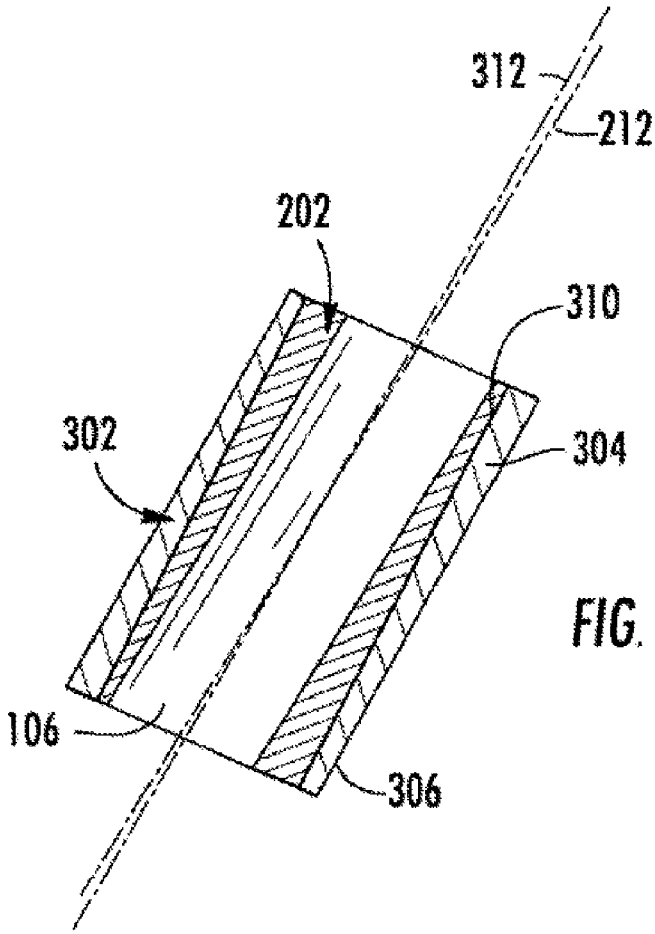
FIG. 3 is a cross-sectional perspective view of an example head adapter engaging a shaft adapter according to certain embodiments of the invention.

As shown in FIG. 3, the shaft adapter 202 may be configured to fit entirely within the head adapter 302. Yet, in other embodiments, shaft adapter 202 will extend less than 50% of an overall axial length of the head adapter 302, and it may extend less than 35%, less than 25%, or even less than 15% of the overall axial length of the head adapter 302. This feature can help keep the overall connection assembly relatively short, compact, and lightweight. Alternatively, if desired, a portion of the shaft adapter 202 may remain outside the head adapter 302 (and optionally, the exterior shape of the shaft adapter 202 outside of the head adapter may be different from the exterior shape of the shaft adapter 202 located within the head adapter). As discussed below in relation to FIG. 6, the configuration of the shaft adapter 202 and its arrangement with respect to the club head body may be utilized to adjust various positions and/or angles of the ball striking surface of the golf club head 102 (e.g., lie angle, loft angle, face angle, etc.).

In other embodiments, the exemplary head adapter 302 may be sized to be received within a hollow portion, such as the bore 210 of the shaft adapter 202, for example, as described in relation to certain embodiments above where the shaft member 106 fits within the shaft adapter 202. Further, in other embodiments, the head adapter 302 may be integral to or otherwise permanently affixed to a club head 402, such as being received with hosel area 404.

B. Methods of Assembling

FIG. 4 shows an exploded perspective view of an exemplary golf club 400 according to certain embodiments of the invention. The exploded view of golf club 400 also highlights one of the several methods that may be used for constructing golf clubs according to certain aspects of the invention. According to one exemplary method, the shaft member 106 is attached to the shaft adapter 202 having a first end 204 and a second end 206 along a first axis 208, wherein the shaft member 106 is inserted within a bore 210 extending along a second axis 212 (axis 212 is shown in FIG. 2). The shaft member 106 may be permanently fixed to the shaft adapter 202 (e.g., via cements or adhesives, via fusing techniques (e.g., welding, soldering, or brazing), etc.) or these parts 106 and 202 may be releasably connected to one another. The method may further comprise inserting the second end 206 of the shaft adapter 202 within a bore 310 of a head adapter 302, wherein the head adapter 302 comprises a first end 304 and a second end 306 along a first axis 308 and wherein the bore 310 has the cross-sectional shape of a regular polygon along a second axis 312 that is shaped to receive the second end 206 of the shaft adapter 202 in a plurality of different orientations. The method may further comprise inserting the head adapter 302 into a hosel area 404 of a club head 402 (the hosel area 404 may have an internal opening of a polygon shape shaped to receive the exterior surface of the second end of the head adapter 302). In select embodiments, the insertion of the head adapter 302 into the hosel area 404 may be selected from a plurality of different orientations, for example, as discussed below in relation to FIGS. 5A-5D and FIG. 6. Accordingly, further methods may include: removing the shaft adapter 202 from the head adapter 302 and reinserting the second end 206 of the shaft adapter 202 into the bore 310 of the head adapter 302 in a different orientation; and/or removing the head adapter 302 from the hosel area 404 of the club head 402 and reinserting the head adapter 302 into the hosel area 404 of the club head 402 in a different orientation.

Exemplary hosel area 404 may comprise an interior chamber or bore for receiving the head adapter 302. The bore may be machined into the golf club head 402 during manufacturing of the head. In one embodiment, the hosel area 404 is created by drilling or otherwise excavating a portion of golf club head 402. In this regard, at least a portion of the outer perimeter of the hosel area 404 comprises the same materials as the golf club head 402. The shaft member 106 may be secured to the club head 402 (through the shaft adapter 202 and the head adapter 302) in any desired manner, including releasable connection systems that are known and used in the art. For example, as illustrated in FIG. 4A1, a threaded nut 410 provided on the shaft member 106 may engage a threaded portion 412 provided on the hosel 404. As another example, a threaded bolt may extend through an opening provided in the club head (e.g., in the club head sole) that engages a threaded portion provided in the bottom of the shaft member 106, the shaft adapter 202, and/or the head adapter 302. Other releasable connection systems, like those described in U.S. Patent Nos. U.S. Pat. No. 6,890,269 (Bruce D. Burrows) and U.S. Published Patent Appln. No. 2004/0018886 (Bruce D. Burrows) may be used without departing from this invention. These patents are each entirely incorporated herein by reference.

C. Adjusting the Head Adapter and the Shaft Adapter

Because the axis of the bore 210 in the shaft adapter 202 is offset from the axis of the exterior surface of the shaft adapter 202, and because the axis of the bore in the head adapter 302 is offset from the axis of its exterior surface, rotation of either of these adapters with respect to the club head 402 will change the position of the shaft member 106 with respect to the ball striking face of the club head. FIGS. 5A-5D each show a top view of a portion of a golf club according to various embodiments of the invention where both the shaft adapter 202 and head adapter 302 may be placed in one of several rotational orientations in relation to club head 402. Specifically, looking to FIG. 5A, shaft member 106 is securely retained within shaft adapter 202. As seen, shaft adapter 202 has an outer exterior shape of an octagon, which engages and mates with the head adapter 302, which has an octagon-shaped inner perimeter bore for receiving the shaft adapter 202. As discussed above, the shaft adapter 202 and the head adapter 302 are not required to be the same shape, but rather only required to mate in each other in one of several rotational orientations in relation to one another and/or in relation to the club head 402, for example, as also described below.

The exemplary shaft adapter 202 of FIGS. 5A-5D comprises indicia 502 and the exemplary head adapter 302 comprises indicia 504. Indicia 502 on shaft adapter 202 indicates the rotational position of the shaft adapter 202 with respect to the head adapter 302, and subsequently the club head 402. Indicia 504 on head adapter 302 indicates the rotational position of the head adapter 302 in relation to the club head 402 and also the shaft adapter 202. The indicia 502, 504 are advantageous to allow users to better record the club head/shaft orientation and/or to allow a reliable return to a previous position after rotation of one or more of the components in relation to the shaft member 106 has taken place. Because both the exemplary shaft adapter 202 and the head adapter 302 are generally octagon-shaped in this example structure, there are 64 rotational orientations they may engage and securely mate in a releasable manner. Therefore, the following discussion will refer to the positions of the shaft adapter 202 and the head adapter 302 as being in a rotational position ranging from 1 to 8, where position 1 refers to when the indicia 502, 504 are at the 12 o'clock position in FIG. 5A and the subsequent positions are consecutively numbered in a clockwise fashion. In yet further embodiments, if desired, club head 402 may be marked with indicia.

Figure 5A:
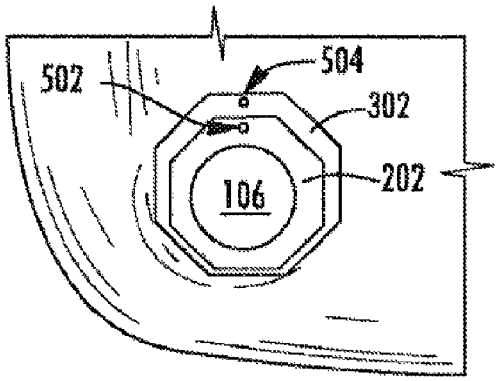
FIGS. 5A and 5B illustrate the rotation of an example shaft adapter in relation to a club head according to one embodiment of the invention.
Figure 5B:
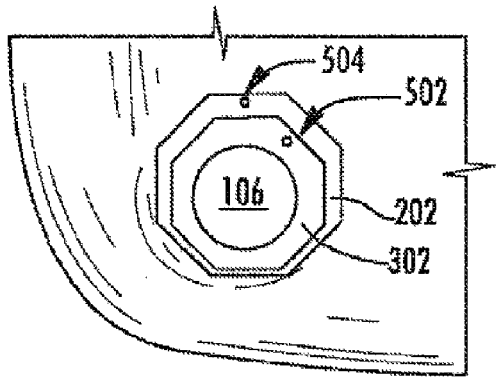

Depending on how the shaft adapter 202 and/or the head adapter 302 are positioned in relation to the "face" of the club head 102, the playing characteristics of the club may be modified. This feature, along with the releasable connection system 104, allows club fitters (or others) to freely and easily adjust various angles and/or positions of the shaft member 106 with respect to the club head 102 (e.g., variable lie, loft, and face angle combinations) while still using the same shaft 106 and/or head 102, which can help users more easily determine the optimum club head/shaft combination and arrangement to suit their needs. Looking to FIG. 5A, indicia 502 indicates that the shaft adapter 202 is in position 1, and indicia 504 indicates that the head adapter 302 is also in position 1. As seen in FIG. 5B, the shaft adapter 202 (and thus the shaft 106) has been rotated to position 2, while the head adapter 302 remains in position 1.

Repositioning the shaft adapter 202 in relation to the head adapter 302 may be advantageous to adjust the club head/shaft orientation by a known factor. For example, information may be associated with the shaft adapter 202 and the head adapter 302 relating to the angle of the offset-axes of the bores 210, 310. The information may be provided with the adapters 202, 302, may be printed, engraved, or otherwise marked on the adapters 202, 302, themselves, or may otherwise be made available.

FIG. 6 provides table 600 which shows exemplary information relating to adjusting the shaft adapter 202 in relation to the club head 402 (while the head adapter 302 remains at a constant position with respect to the club head 402). The information relates to the example embodiment shown in FIG. 3, where both the shaft adapter 202 and the head adapter 302 are generally octagon shaped. In the specific embodiment, the shaft adapter's bore 210 is offset at about 2 degrees from center and the head adapter's bore 310 is offset at about 1 degree from center. Table 600 shows the changes to the face angle (column 604), lie angle (column 606), and the loft (column 608) from rotating the shaft adapter 202 with respect to the head adapter 302, one-eighth of the full rotation (or about 45 degrees) in a clock-wise direction. As seen in the first line of column 602, the shaft adapter 202 is set to position 1 (thus as shown in FIG. 5A, indicia 502 is at the 12 o'clock position). When the shaft adapter 202 and the head adapter 302 are set to position 1 (as shown in FIG. 5A), the face angle and the loft are not changed, however, the lie angle is located at +3 degrees (see line 610 of FIG. 6).

Figure 5C:
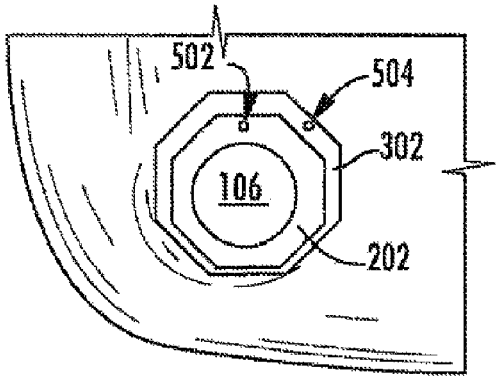
FIGS. 5C and 5D illustrate the rotation of an exemplary shaft adapter and an exemplary head adapter in relation to a club head in accordance with one embodiment of the invention.
Figure 5D:
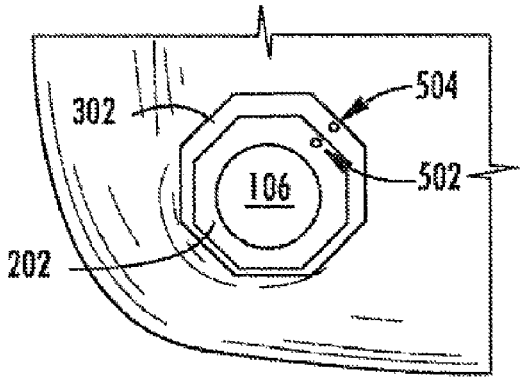

When the shaft adapter 202, however, is set to position 2 (or rotated about 45 degrees in the clock-wise direction) and the head adapter 302 remains in position 1, for example, as shown in FIG. 5B, the face angle is adjusted −0.7 degrees, the lie angle changes to +2.4 degrees, and the loft increases 1.2 degrees (See line 612 of FIG. 6). As shown in the remainder of table 600, the face angle, lie angle, and loft may be adjusted to known quantities by repositioning the shaft adapter 202 in relation to the head adapter 302. Further, as shown in FIGS. 5C-5D, the head adapter 302 may also be adjusted, either independently or in combination with the repositioning of the shaft adapter.

In further embodiments, the "sides" of the shaft adapter 202 and/or the head adapter 302 may include protrusions on the perimeter. For example, the components may have a generally circular shape, however, protrusions may be placed or otherwise disposed on the perimeter of the structure such as to create substantially the same effect as the "walls." Indeed, any structures, shapes, extensions or the like whose characteristics mimic traditional sides are within the scope of the invention and are encompassed within the term "sides" as used herein. In some more specific exemplary structures according to the invention, the rotation inhibiting structure of the interior chamber will have a square or rectangular cross section. In yet other embodiments, the interior chamber may be irregularly shaped such that the "sides" are not equal. This may be useful, for example, where it is desirable that a shaft not be inserted in a manner that would not provide good club characteristics. In one embodiment, there are a plurality of possible configurations that the shaft adapter may be received within the golf club head, wherein at least one configuration provides different club characteristics than another configuration.

D. Additional Embodiments

1. Generally

The releasable connection assemblies may be provided in any desired structures and/or used in any desired manner without departing from the invention. The clubs with such connection assemblies may be designed for use by the golfer in play (and optionally, if desired, the golfer may freely change shafts, heads, and/or their positioning with respect to one another). As another example, if desired, clubs including releasable connections in accordance with the invention may be used as club fitting tools and when the desired combination of head, shaft, and positioning have been determined for a specific golfer, a club builder may use the determined information to then produce a final desired golf club product using suitable (and permanent) mounting techniques (e.g., cements or adhesives). Other variations in the club/shaft connection assembly parts and processes are possible without departing from this invention.

2. Kits

As additional example aspects of this invention, one or more elements or components of a golf club and/or its connection assembly may be marketed, sold, or utilized as a kit. One such embodiment may include a kit comprising a golf club head having an interior chamber configured to receive an insertable head adapter 302. In yet other embodiments, the head adapter 302 may be permanently affixed to or otherwise formed as a part of the golf club head. Additionally or alternatively, the kit further may include the shaft adapter 202 and/or a shaft member 106.

Kits may be associated with instructions for constructing a golf club with the head and choosing between one or more shafts, shaft adapters, and/or other elements to construct a golf club. In certain embodiments, the instructions will describe a method for: inserting a shaft member 106 into the bore 210 at the first end 204 of the shaft adapter 202; inserting the second end 206 of the shaft adapter 202 into the bore 310 of the head adapter 302 in one of a plurality of different orientations; and/or inserting the head adapter 302 into the hosel area of a club head 402, wherein the head adapter 302 may be fit within the hosel area at a plurality of different orientations. In yet further embodiments, the kit may include information relating to the face angle, lie angle, and loft angle of the club head 402 in relation to the different orientations of the shaft adapter 202 and/or the head adapter 302 in the hosel area of the club head 402.

A kit may contain one or more shafts, shaft adapters, heads, and/or instructions depending on the various embodiments. The kits may further comprise information relating to the face angle, lie angle, and loft angle of the club head in relation to an orientation of a specific shaft adapter and/or head adapter in the interior chamber of a specific club head. One skilled in the art will readily appreciate that the instructions are not required to be printed and remain physically present with the other components of the kit, but rather the instructions may be provided on a computer-readable medium. Such instructions may reside on a server that the user may access. In accordance with certain embodiments, the user may be provided information, such as a link to an address on the Internet, which comprises the instructions, which would fall within the scope of providing instructions. Thus, as used herein, providing instructions is not limited to printed copies that are deliverable with a physical element of the golf club.

3. Axial Direction Change Regions

Other structures of the golf club 100 may be used in conjunction with the connection system 104 described above in connection with FIGS. 2 through 6 to further increase the benefits of the disclosed golf club. For example, additional structures may further include an axial direction change region. Exemplary shafts having one or more direction change regions are disclosed and described in U.S. patent application Ser. No. 11/774,522 which is entirely incorporated herein by reference. Further, the shaft adapters and/or head adapters described above may be used with other releasable golf club head/shaft connection arrangements, such as those described in U.S. Pat. No. 6,890,269 (Bruce D. Burrows) and U.S. Published Patent Appln. No. 2004/0018886 (Bruce D. Burrows), each of which is entirely incorporated herein by reference. Moreover, various aspects of the invention described above may be used in connection with other patented, pending, and/or commercially available releasable golf club shaft assemblies.

Many variations in the overall structure of the shaft, club head, and club head/shaft connection assembly are possible without departing from this invention. Furthermore, the various steps of the described assembly processes may be altered, changed in order, combined, and/or omitted without departing from the invention. Additionally or alternatively, if desired, in such structures, the club head can be quickly and easily exchanged for a different one on the shaft (e.g., a club head of different loft, lie angle, size, brand, etc.) and/or the shaft can be quickly and easily exchanged for a different one on the club head (e.g., of different material, of different flex, with different kick point characteristics, etc.).

CONCLUSION

While the invention has been described in detail in terms of specific examples including presently preferred modes of carrying out the invention, those skilled in the art will appreciate that there are numerous variations and permutations of the above described systems and methods. Thus, the spirit and scope of the invention should be construed broadly as set forth in the appended claims.

We claim:

1. A golf club comprising:

a shaft adapter having a first end and a second end along a first axis, the shaft adapter further comprising a shaft adapter bore along a second axis configured to attach to a shaft member on the second axis, and wherein the second end of the shaft adapter is configured to engage a head adapter, wherein the first axis is off-set from the second axis, thereby creating an off-axis bore in the shaft adapter, and wherein an exterior surface of the second end of the shaft adapter has a cross-sectional shape of a regular polygon and an outer surface of the shaft adapter between the first end and the second end is tapered in an axial direction along the shaft adapter;

a head adapter having a first end and a second end along a first axis, the head adapter further comprising a head adapter bore having a shape of a regular polygon along a second axis that is shaped to receive the second end of the shaft adapter in a plurality of different orientations, wherein the first axis is off-set from the second axis, thereby creating an off-axis bore in the head adapter, and wherein an exterior surface of the second end of the head adapter has a cross-sectional shape of a regular polygon that engages a polygonal bore of a hosel area of a club head, wherein at least one of the head adapter bore or the exterior surface of the shaft adapter has a different quantity of sides than the other of the head adapter bore or the exterior surface of the shaft adapter; and a shaft member, wherein the shaft adapter is permanently engaged with the shaft member or is releasably engaged with the shaft member;

a club head having a hosel area, and wherein the second end of the head adapter is able to be received within the hosel area of the club head in one of a plurality of different possible orientations, wherein a face angle, a lie angle, and a loft angle of the club head relates to at least one of different orientations of the shaft adapter and the head adapter with respect to one another and different orientations of the shaft adapter and the head adapter with respect to the hosel area of the club head.

2. The golf club of claim 1, wherein the second axis of the shaft adapter is off-set from the first axis of the shaft adapter at about 1 degree.

3. The golf club of claim 1, wherein the second axis of the head adapter is off-set from the first axis of the head adapter at about 2 degrees.

4. The golf club of claim 1, wherein the shaft adapter is configured to securely and releasably engage the head adapter in a plurality of orientations selected from the group consisting of 4, 8, 10, 12, and 16.

5. The golf club of claim 1, wherein the cross-sectional shape of the shaft adapter is square and the bore of the head adapter has a quantity of sides selected from the group consisting of 8, 10, 12, and 16.

6. The golf club of claim 1, wherein the head adapter bore along the second axis of the head adapter is tapered in an axial direction along the head adapter.

7. A golf club head and shaft connecting system, comprising:

a shaft adapter having a first end and a second end along a first axis, the shaft adapter further comprising a shaft adapter bore along a second axis configured to attach to a shaft member on the second axis, wherein the second end of the shaft adapter is configured to engage a head adapter, wherein the first axis is off-set from the second axis, thereby creating an off-axis bore in the shaft adapter, and wherein an exterior surface of the second end of the shaft adapter has a cross-sectional shape of a regular polygon and an outer surface of the shaft adapter between the first end and the second end is tapered in an axial direction along the shaft adapter; and a head adapter having a first end and a second end along a first axis, the head adapter further comprising a head adapter bore having a shape of a regular polygon along a second axis that is shaped to receive the second end of the shaft adapter in a plurality of orientations, wherein the first axis is off-set from the second axis, thereby creating an off-axis bore in the shaft adapter, and wherein an exterior surface of the second end of the head adapter has a cross-sectional shape of a regular polygon that engages a polygonal bore of a hosel area of a club head, wherein at least one of the head adapter bore or the exterior surface of the shaft adapter has a different quantity of sides than the other of the head adapter bore or the exterior surface of the shaft adapter.

8. A golf club head and shaft connecting system of claim 7, further comprising:

instructions for instructing a person to perform a method of:

inserting a shaft member into the shaft adapter bore at the first end of the shaft adapter; and inserting the second end of the shaft adapter into the bore of the head adapter in one of a plurality of different orientations.

9. The golf club head and shaft connecting system of claim 8, further comprising:

a club head having a hosel area with a cross-sectional area of a regular polygon, and wherein the instructions further instruct a person to perform the method of:

inserting the head adapter into the hosel area of the club head at one of a plurality of different orientations.

10. The golf club head and shaft connecting system of claim 9, further comprising:

information relating to a face angle, a lie angle, and a loft angle of the club head in relation to at least one of different orientations of the shaft adapter and the head adapter with respect to one another or different orientations of the shaft adapter and the head adapter with respect to the hosel area of the club head.

11. A golf club comprising:

a shaft adapter having a first end and a second end along a first axis, the shaft adapter further comprising a shaft adapter bore along a second axis configured to attach to a shaft member on the second axis, and wherein the second end of the shaft adapter is configured to engage a head adapter, wherein the first axis is off-set from the second axis, thereby creating an off-axis bore in the shaft adapter, and wherein an exterior surface of the second end of the shaft adapter has a cross-sectional shape of a regular polygon;

a head adapter having a first end and a second end along a first axis, the head adapter further comprising a head adapter bore having a shape of a regular polygon along a second axis that is shaped to receive the second end of the shaft adapter in a plurality of different orientations, wherein the first axis is off-set from the second axis, thereby creating an off-axis bore in the head adapter, and wherein an exterior surface of the second end of the head adapter has a cross-sectional shape of a regular polygon that engages a polygonal bore of a hosel area of a club head and the head adapter bore along the second axis of the head adapter is tapered in an axial direction along the head adapter, wherein at least one of the head adapter bore or the exterior surface of the shaft adapter has a different quantity of sides than the other of the head adapter bore or the exterior surface of the shaft adapter; and a shaft member, wherein the shaft adapter is permanently engaged with the shaft member or is releasably engaged with the shaft member;

a club head having a hosel area, and wherein the second end of the head adapter is able to be received within the hosel area of the club head in one of a plurality of different possible orientations, wherein the cross-sectional shape of the exterior surface of the second end of the shaft adapter has a quantity of sides selected from the group consisting of 4, 8, 10, 12, and 16, and wherein the bore of the head adapter has a quantity of sides selected from the group consisting of 4, 8, 10, 12, and 16.

12. The golf club of claim 11, wherein the second axis of the shaft adapter is off-set from the first axis of the shaft adapter at about 1 degree.

13. The golf club of claim 11, wherein the second axis of the head adapter is off-set from the first axis of the head adapter at about 2 degrees.

14. The golf club of claim 11, wherein a face angle, a lie angle, and a loft angle of the club head relates to one of the plurality of orientations of the shaft adapter and the head adapter with respect to one another and one of the plurality of orientations of the shaft adapter and the head adapter with respect to the hosel area of the club head.

15. The golf club of claim 11, wherein the cross-sectional shape of the shaft adapter is square and the bore of the head adapter has a quantity of sides selected from the group consisting of 8, 10, 12, and 16.

16. The golf club of claim 11, wherein an outer surface of the shaft adapter between the first end and the second end is tapered in an axial direction along the shaft adapter.

* * * * *